US006719679B1

(12) United States Patent
Lin

(10) Patent No.: US 6,719,679 B1
(45) Date of Patent: Apr. 13, 2004

(54) PERFORATION DEVICE

(76) Inventor: Yun Yu Lin, P.O. Box 590, Taichung City (TW), 400

( * ) Notice: Subject to any disclaimer, the term of this patent is extended or adjusted under 35 U.S.C. 154(b) by 0 days.

(21) Appl. No.: 10/303,963

(22) Filed: Nov. 26, 2002

(51) Int. Cl.[7] ..... B21B 1/16

(52) U.S. Cl. ..... 493/238; 493/194; 493/199; 493/227; 493/233; 83/620; 83/660

(58) Field of Search ..... 83/613, 620, 660; 493/194, 195, 196, 199, 227, 238, 233

(56) References Cited

U.S. PATENT DOCUMENTS 2,640,540 A * 6/1953 Stange ..... 83/300
3,802,308 A * 4/1974 Davis, Jr. ..... 63/99
4,833,867 A * 5/1989 Reichstahler ..... 53/567
4,920,584 A * 5/1990 Abdrabbo ..... 4/245.1
5,001,956 A * 3/1991 Nitsch ..... 83/620
5,934,048 A * 8/1999 Bouressa ..... 53/552

* cited by examiner

*Primary Examiner*—Eugene Kim
*Assistant Examiner*—Christopher Harmon

(57) ABSTRACT

A perforation device for making roll of plastic bag with an opening and a perforation line on each bag, comprising a cutting unit, an anvil unit and a expanding board, wherein, the cutting unit involves a main unit whereto are fitted with a toothed blade and a specified number of compressing blocks, the expanding board serving to expanding the material bag, the toothed blade on the cutting unit serving to cut and punch a surface of the material bag, making a roll of plastic bags each having an opening on one side, thereby fully automated packaging can be achieved by installing the present invention on an automatic weighing and packaging machine or a in conveyor packaging line for convenient packaging process, to reduce labor cost and enhance packaging efficiency.

1 Claim, 7 Drawing Sheets

PERFORATION DEVICE

BACKGROUND OF THE INVENTION (a) Field of the Invention

The invention relates to a perforation device for making roll of plastic bag with an opening and a perforation line on each bag.

(b) Description of the Prior Art

As shown in FIG. 1, a conventional roll of plastic bag which linked by perforation line (B) is made by a sealing device and a perforation device, each bag of material roll is formed by a sealing line (A) and a perforation line (B). To use the roll of plastic bags in prior art, each bag needs to be torn off along the perforation line to form an opening for package, this manual process involves much increase of packaging time, waste of manual work, and the most important, the roll could not be incorporated with automatic weighing and packaging machine or a conveyor for automatic package in a mass production line. A latest prior art has been disclosed in U.S. Pat. No. 6,086,524 to Martin, filed on Nov. 14, 1996, entitled "RECLOSABLE STORAGE BAG AND METHOD FOR MAKING THE SAME". The patent disclosed a reciprocal cutting unit device 223, two bolts with springs and two compressing blocks 163 and 165, and a serrated cutting edge. The storage bag provided by that patent involves a piece of reclosable string, the string being incorporated as an integrated marginal part of the bag outside a margin of the storage bag.

The storage bag disclosed by Martin includes a string, and is not applicable for production of a roll of plastic bags, therefore, it is not suitable for automated operation involving weighing and packaging machine or conveyor packaging line.

SUMMARY OF THE INVENTION

The objective of the present invention is to provide a perforation device for making roll of plastic bag with an opening and a perforation line on each plastic bag. The perforation device comprising a cutting unit, an anvil unit and an expanding board. The cutting unit comprises a holder, toothed blade and a specified number of compressing blocks, the expanding board expands the inner of material plastic bag to a specified space, the toothed blade then cuts into the material bags to make an opening and a perforation line on the material plastic bag. The roll of plastic bag made by present invention is ideal for incorporated with an automatic weighing and packaging machine or a conveyor on a production line as a high efficiency packaging system.

A preferred embodiment of the invention is described below to achieve the objective of the present invention.

DETAILED DESCRIPTION OF PREFERRED EMBODIMENTS

Figure 1:
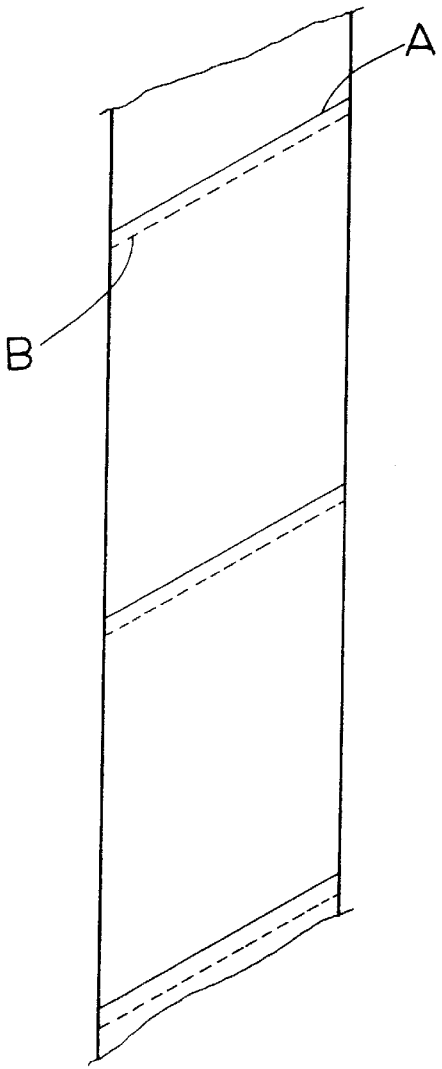
FIG. 1 is a plan view of a prior art of plastic bags in rolls.
Figure 2:
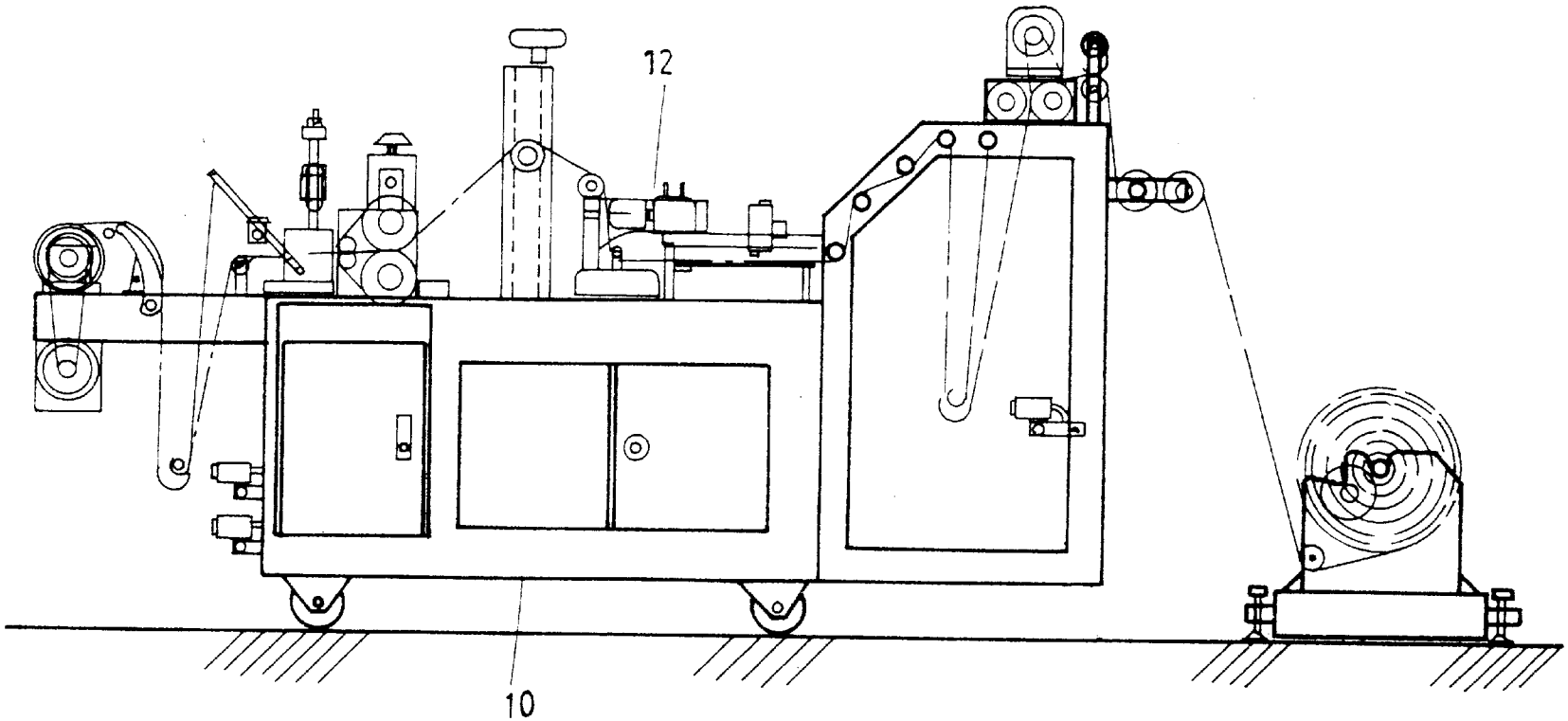
FIG. 2 is a plan view of the present invention as installed on a printing/sealing machine.
Figure 3:
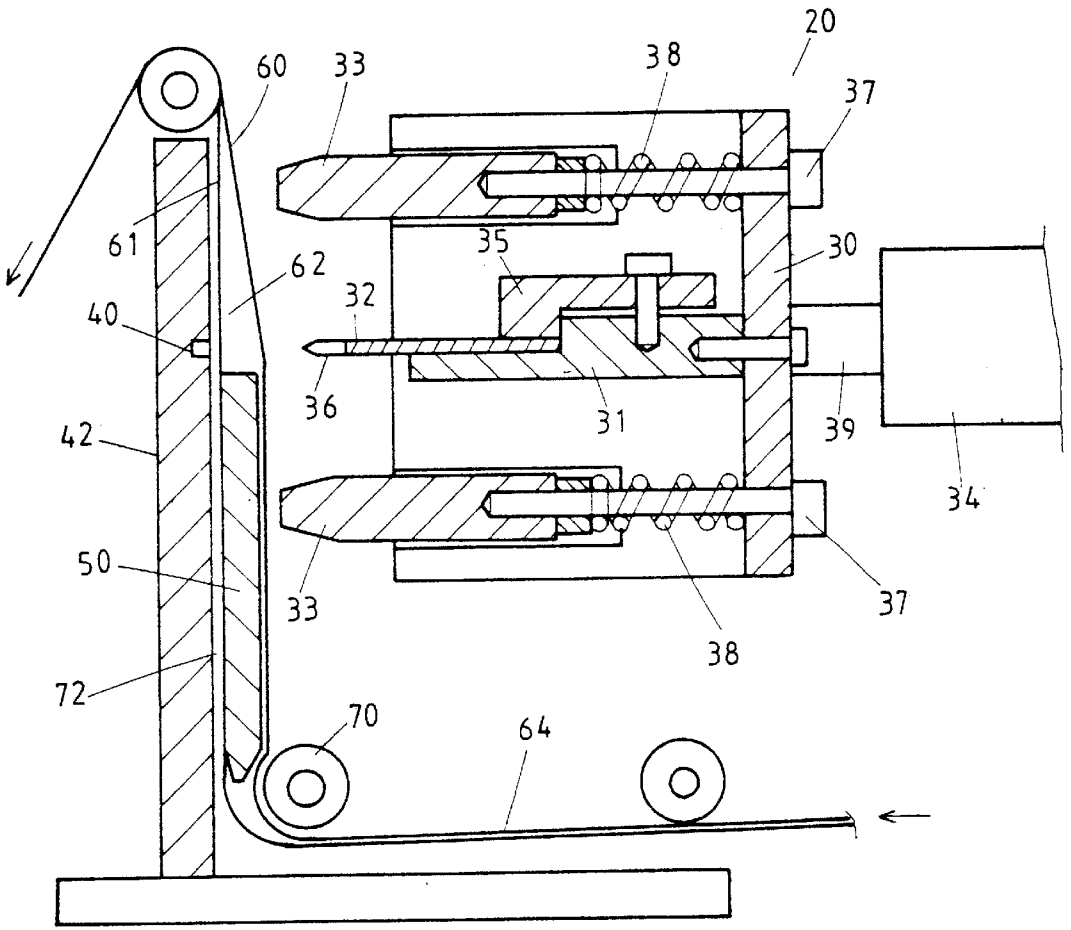
FIG. 3 is a section view of the invention.
Figure 4:
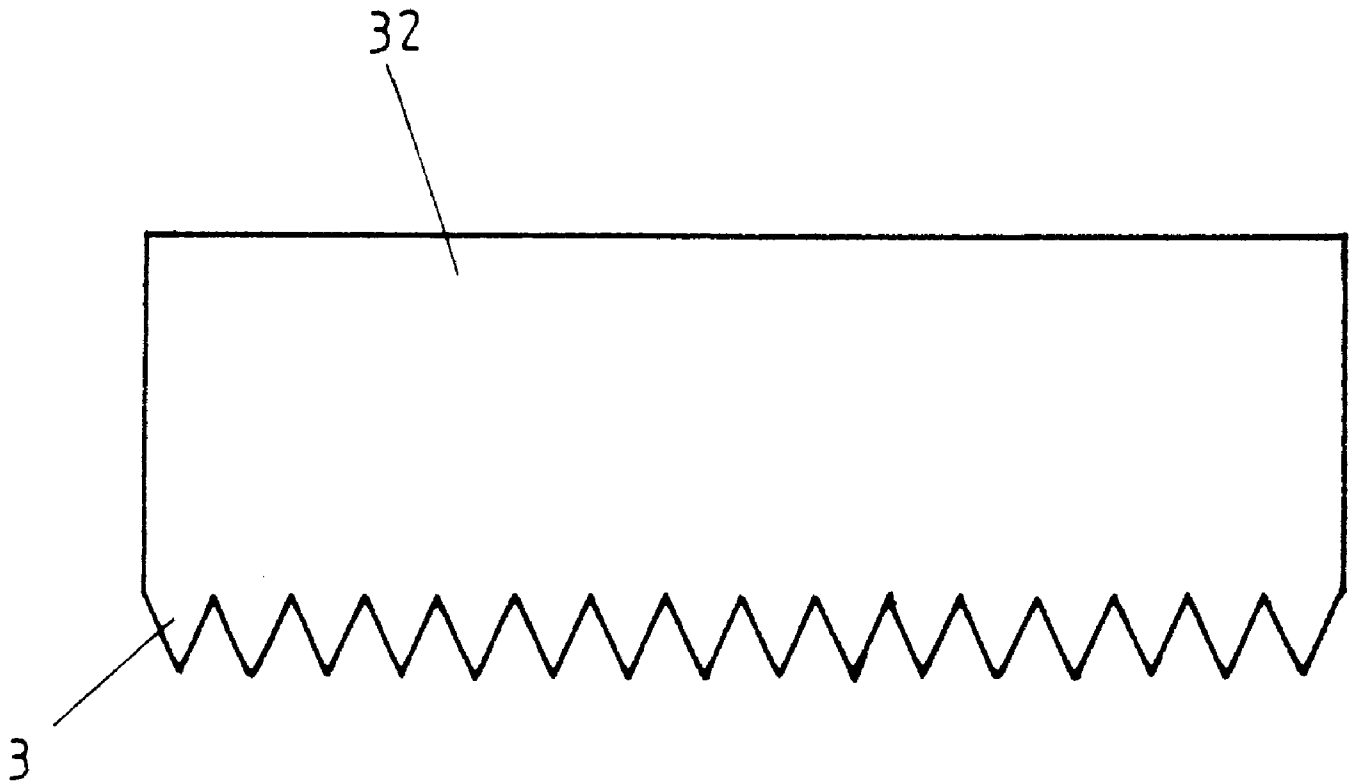
FIG. 4 is a plan view of a toothed blade in the invention.

As shown in FIGS. 2 and 3, the device in present invention can be installed on a printing/sealing machine 10 for the purpose of processing material plastic bag 64 into a roll of printed plastic bags with an opening and a perforation line on each bag. The present invention comprises a cutting unit 20, an anvil unit 42 and a expanding board 50. The cutting unit 20 comprises a main unit 30, a holder 31, a toothed blade 32 and two compressing blocks 33. One side of the main unit 30 is installed to a spindle 39 of a driving unit 34 (such as a pneumatic cylinder) that controls the entire cutting unit 20 in reciprocal movement during its punching and cutting operation. On the other side of the main unit 30 are a holder 31 and two compressing blocks 33. On the holder 31 is attached a compressing block 35 for securing and adjusting the toothed blade 32. One side of the toothed blade 32 has a toothed part 36 (shown in FIG. 4). Each of the compressing blocks 33 is attached to an upper part and a lower part of the holder 31 by means of a bolt 37 and a compressing spring 38 for moving forward and backward from the main unit 30 when subjected to a driving force. A groove 40 with certain depth on anvil unit 42 is positioned at the corresponding position to the toothed blade 32.

The material plastic bag 64 are located to one side of the anvil unit 42, and the expanding board 50 is disposed in the material plastic bag 64. Thus an inner side 61 of the material plastic bag 64 is disposed in a clearance 72 between the expanding board 50 and the anvil unit 42. One end of the expanding board 50 inside the material bag 64 is resting on a roller 70. Since the expanding board 50 is disposed in the material plastic bag 64, the inner side 61 and an outer side 60 of the material plastic bag 64 envelope and limit the expanding board 50 within, so the expanding board 50 will not tilt or fall out. The expanding board 50 insides the material plastic bag 64 forming an expanding space 62 between the outer side 60 and the inner side 61.

Figure 5:
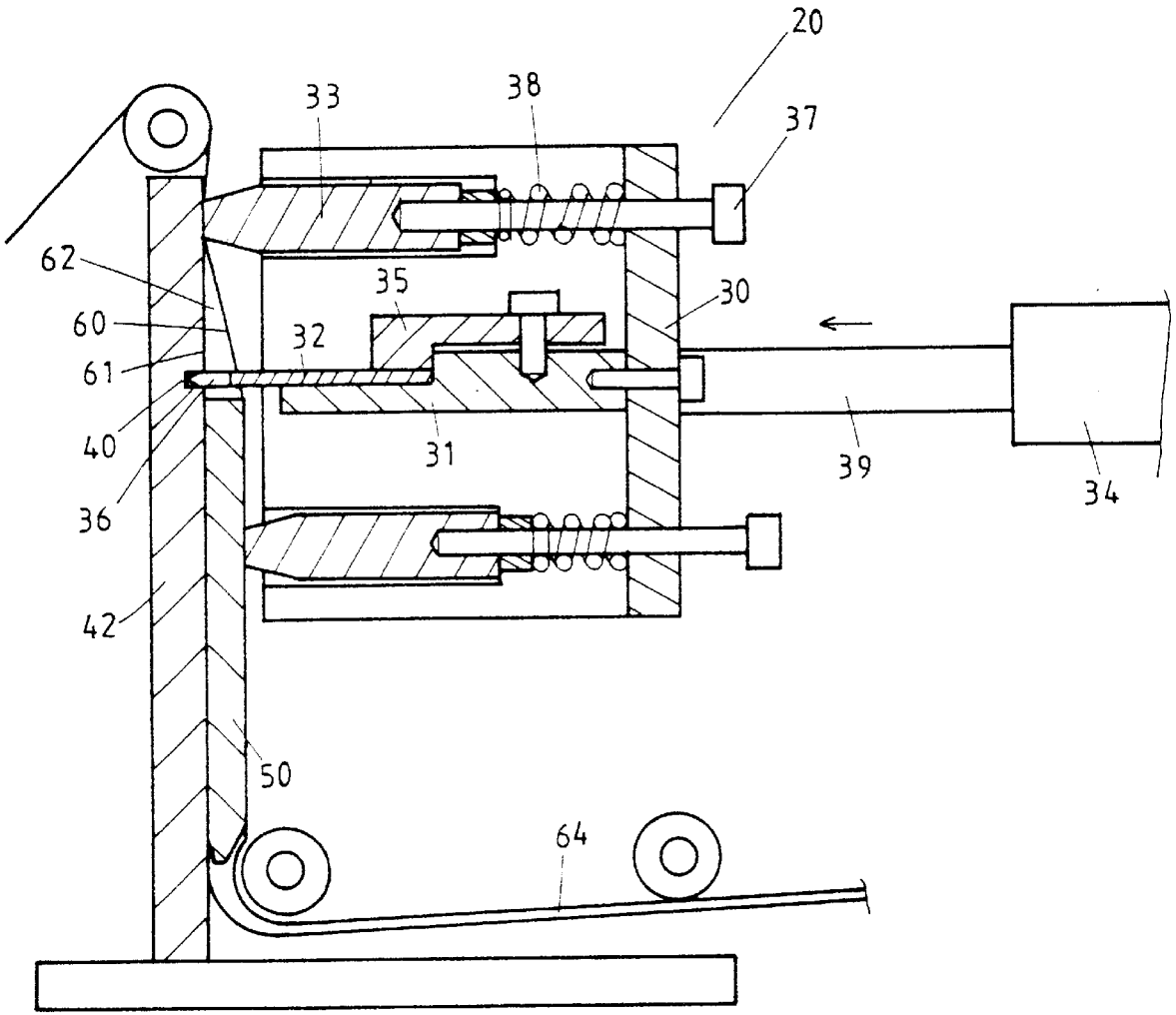
FIG. 5 is a section view of the invention in operation.
Figure 6:
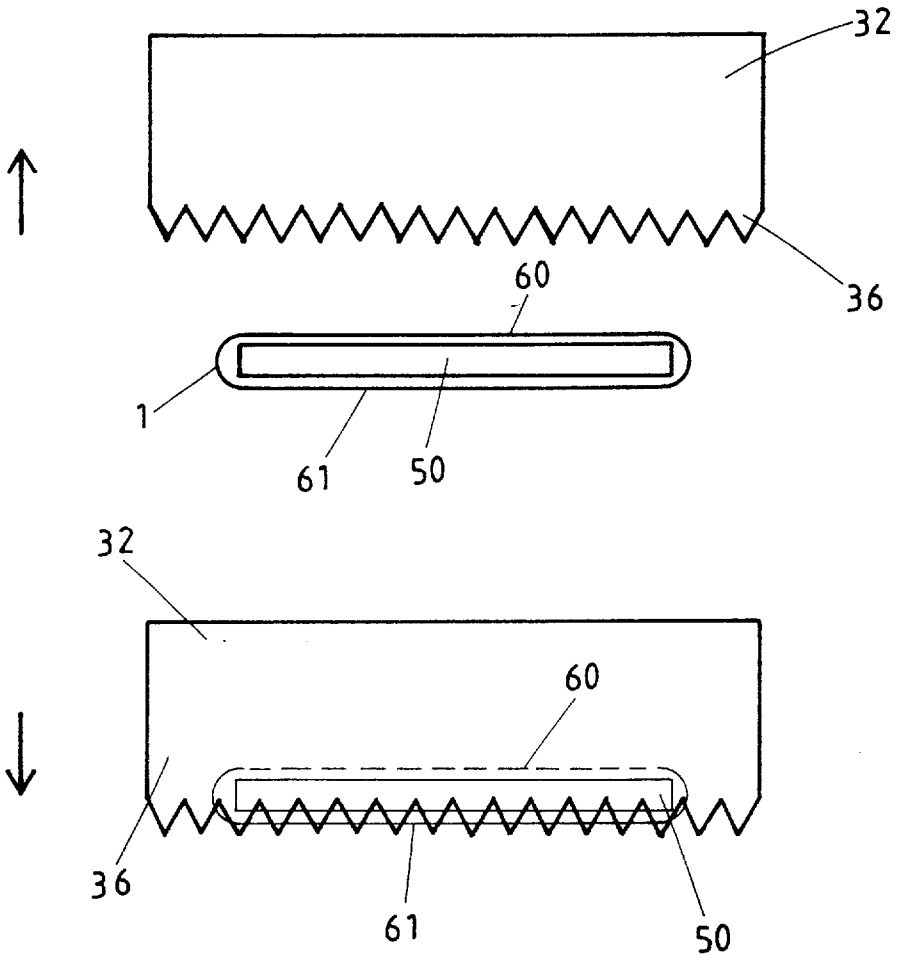
FIG. 6 is a plan view of the toothed blade and material plastic bag of the invention in operation.

As shown in FIG. 5, when the spindle 39 of the driving unit 34 (such as a pneumatic cylinder) moves forward and pushes the holder 20 to the anvil unit 42, the compressing block 33 at the lower part of the main unit 30 presses the outer side 60 of the material plastic bag 64 against the expanding board 50 thus pushes the expanding board 50 further against the anvil unit 42, so the inner side 61 of the material plastic bag 64 is compressed between, thereby fixes the position for toothed blade 32 cutting on the material plastic bag 64; meanwhile, the upper part of compressing block 33 also presses both the outer side 60 and inner side 61 of the material bag 64 against the anvil unit 42, fixes the position of the material plastic bag 64 on the expanding board 50 and forms a space 62. While the holder 20 pushed to the anvil unit 42, the toothed blade 32 of the holder 20 moves and cuts through the outer side 60 of the material plastic bag 64 during the movement, the complete penetration made on the material plastic bag forms an opening on it, then the tips of toothed part 36 punched the inner side 61 of bag and moved into the groove 40 makes a perforation line on the inner side 61 of material plastic bag 64, thereby a roll of plastic bag with an opening and a perforation line on each bag is produced by repeat above operation on material plastic bag.

Figure 7:
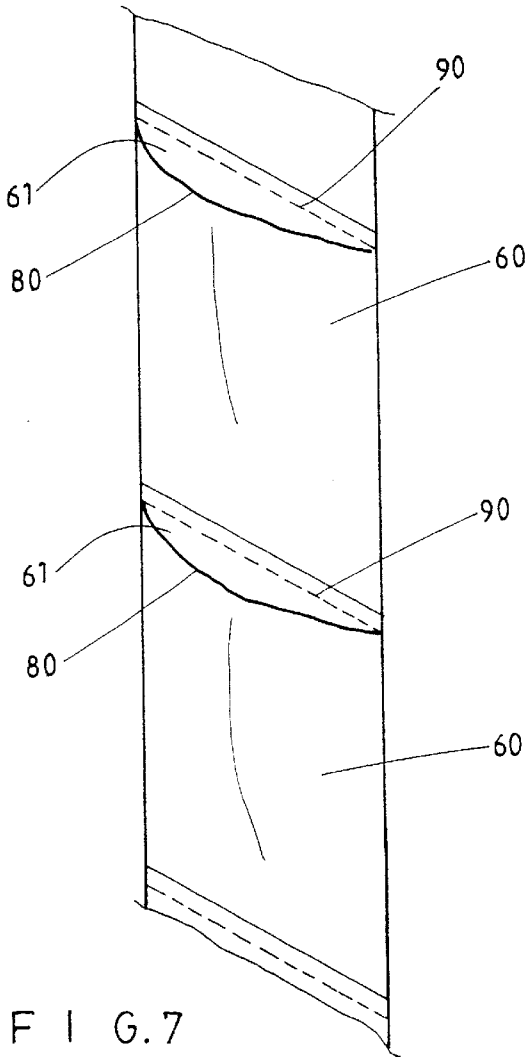
FIG. 7 is a plan view of finished product made by present invention.

As shown in FIG. 7, because of the feature of the perforation device in present invention disclosed above, the roll of plastic bag made by the perforation device provides a continuous and already opened bags on the roll for package, especially for auto packaging system with auto filling and weighing facility, saves the process of tearing and opening of the plastic bag and reducing time required for packaging process.

It is to be understood that the above description covering a preferred embodiment and drawings of the present invention shall not be used to limit or restrict the present invention, and that all modifications or variations made without departing from the spirit of the above shall be included in the scope of the subject claim.

What is claimed is:

1. A perforation device for making roll of plastic bag with an opening and a perforation line on each bag, comprising:

a cutting unit, having a main unit that is attached to a driving unit for reciprocal movement, the main unit having a holder fitted with a toothed blade, at specified locations on the main unit around the toothed blade being a specified number of compressing blocks, each fitted with a spring, running axially through the spring being a bolt, one end of the bolt being fixed onto the compressing block, enabling the compressing block to move flexibly and reciprocally when subjected to a driving force;

an anvil unit, having a groove on a surface thereof, the anvil unit being mounted to one side of the cutting unit, at a position to match the toothed blade, the material plastic bag feeding between the anvil unit and the cutting unit; and an expanding board, a movable block that is installed between an inner side and an outer side of the plastic material bag, the inner side of the plastic material bag being maintained in a clearance reserved between the expanding board and the anvil unit, the outer side of the plastic material bag feeding along surfaces of the expanding board, forming a space therein;

thereby, when the spindle of the driving unit pushes forward and moves the cutting unit toward the anvil unit, the compressing block on a lower part of the main unit pressed the outer side of the plastic material bag against the expanding board, pushing the expanding board against the anvil unit and the inner side of the plastic material bag there between, fixing a position for perforation process on the plastic material bag; the compressing block on top also presses two sides of the plastic material bag onto the anvil unit, fixing a position of the plastic material bag on the expanding board, forming a space between, meanwhile, the toothed blade moves forward, cutting into the groove, so the outer side of the plastic material bag is cut and opened because of complete penetration of a toothed part of the toothed blade, while the inner side of the plastic material bag is punched with a perforation line because only the tips of the toothed part of the toothed blade is pushed into the groove, thereby making a roll of plastic bags with an opening and a perforation line on each bag.

* * * * *